United States Patent [19]

Park et al.

[11] Patent Number: 4,598,777

[45] Date of Patent: Jul. 8, 1986

[54] METHOD AND APPARATUS FOR PREVENTING CONTAMINATION OF A CORING SPONGE

[75] Inventors: Arthur Park, Odessa; Bob T. Wilson, Midland, both of Tex.

[73] Assignee: Diamond Oil Well Drilling Company, Midland, Tex.

[21] Appl. No.: 661,893

[22] Filed: Oct. 17, 1984

Related U.S. Application Data

[63] Continuation-in-part of Ser. No. 513,267, Jul. 13, 1983, Pat. No. 4,479,557.

[51] Int. Cl.[4] ..... E21B 25/08

[52] U.S. Cl. ..... 175/58; 175/226; 175/249

[58] Field of Search ..... 175/20, 58, 59, 226, 175/244, 249, 250, 251, 252, 253, 308, 403

[56] References Cited

U.S. PATENT DOCUMENTS

| | | | |
|---|---|---|---|
| 1,815,391 | 7/1931 | Zublin et al. | 175/249 |
| 1,853,581 | 4/1932 | Schmissrauter et al. . | |
| 1,857,693 | 5/1932 | Quintrell | 175/249 |
| 2,264,449 | 12/1941 | Mounce . | |
| 2,703,697 | 3/1955 | Walker . | |
| 2,779,195 | 1/1957 | Simon | 175/59 |
| 2,789,790 | 4/1957 | Kirby, II . | |
| 3,064,742 | 11/1962 | Bridwell . | |
| 3,207,240 | 9/1965 | Hugel . | |
| 3,299,959 | 1/1967 | Brown | 166/120 |
| 3,454,117 | 7/1969 | Eckel et al. . | |
| 4,114,694 | 9/1978 | Dinning | 166/318 |
| 4,312,414 | 1/1982 | Park | 175/59 |
| 4,479,557 | 10/1984 | Park et al. | 175/59 |

*Primary Examiner*—Stephen J. Novosad
*Assistant Examiner*—William P. Neuder
*Attorney, Agent, or Firm*—Jerry W. Mills; Gregory M. Howison

[57] ABSTRACT

A well coring apparatus (10) includes an outer barrel (12) and an inner barrel (18). The inner barrel (18) is sealed at one end with a sealing member (80) and has a reciprocating piston (70) disposed in the other end thereof. An O-ring (68) is disposed at the receiving end of the inner barrel (18) to provide a seal therefor. Spring members (76) provide a restrictive force to the piston (70). A sponge (50) is disposed around the inner walls of the inner barrel (18) for contacting the core (82). A fluid is disposed in the inner space (78) of the inner barrel (18) and pressurized. Reciprocation upward of the piston (70) causes the fluid to flow therefrom out the receiving end of the inner barrel (18). This flow of fluid washes the sides of the core (82) to prevent drilling mud from caking about the surfaces thereof and preventing proper transfer of fluids contained within the core (82) to the sponge (50). The fluid in the inner space (70) has a density that is lower than that for fluids external to the inner barrel (18) such that contamination of the sponge (50) is prevented.

14 Claims, 5 Drawing Figures

METHOD AND APPARATUS FOR PREVENTING CONTAMINATION OF A CORING SPONGE

CROSS REFERENCE TO RELATED APPLICATIONS

This application is a continuation in part of Ser. No. 513,267, filed on July 13, 1983, now U.S. Pat. No. 4,479,557.

TECHNICAL FIELD

This invention pertains in general to an apparatus for well coring and, more particularly, to a well coring apparatus utilizing an absorbent sponge for containing the subterranean fluid in the core.

BACKGROUND OF THE INVENTION

To analyze the amount of oil that is contained in a particular soil at a particular depth in the proximity of a subterranean well requires extraction of a sample of the well material. Analysis of this material yields the percent of fluid contained therein which is utilized to determine the type of fluid, such as oil, contained therein. However, it is important in order to obtain an accurate analysis to extract the core in as intact a condition as possible. Since the fluid and gas are contained in the core material at a pressure dependent upon the depth of the well, extraction of this core to an environment with a lower pressure results in the fluid expanding somewhat and the gas coming out of solution. This expansion and the resultant gas constitutes the "mobile oil" contained in the core which drains or "bleeds" out of the core and can be lost. Mobile oil is a function of the permeability and porosity of the core itself and the volume of fluid contained therein.

One method for retaining mobile oil is sponge coring which is disclosed in U.S. Pat. No. 4,312,414, issued to the present Applicant. Sponge coring comprises disposing a high porosity sponge on the interior surface of the inner barrel of the well coring apparatus. The core is then forced into the inner barrel with the sponge disposed about the sides thereof. The oil and/or gas contained in the core then "bleeds" into the sponge thereby retaining an accurate profile of the oil along the longitudinal axis of the core.

There are a number of problems incurred during sponge coring to achieve accurate data. One of these problems is in having the surface of the sponge contacting the actual surface of the core with no contaminants disposed therein. During normal drilling, drilling mud is circulated around the coring bit. This drilling mud has a tendency to "cake" on the core which, when it is pushed up into the sponge in the inner barrel, can impede bleeding of the oil and/or gas to the sponge for retention therein. This results in a certain degree of inaccuracy. This problem is exacerbated by the high differential pressures that can result within a bore hole due to the formation pressure and the pressure of the drilling mud within the bore hole. Therefore it is necessary to minimize the build-up of this filter cake.

In view of the above described disadvantages with sponge coring, there exists a need for a sponge coring apparatus with reduced field filter cake buildup on the core to increase the accuracy of sponge analysis.

SUMMARY OF THE INVENTION

The present invention disclosed and claimed herein comprises a method and apparatus for recovery of subterranean fluid. The apparatus includes a well coring apparatus for boring a well containing the subterranean fluid. a container is associated with the coring apparatus for receiving and containing the well core for later retrieval. An absorbent member is disposed on the inner walls of the container and positioned adjacent the well core for absorbing the subterranean fluid that bleeds from the well core. The container is sealed at one end opposite the receiving end and has a reciprocating piston disposed at the other end. An O-ring is disposed on the inner walls of the container to provide a seal for the reciprocating piston that is broken when the piston is pushed upwards into the container by the core. A pressurized fluid is disposed within the container for cleansing the absorbent member and preventing contaminents from entering the interior of the container during the drilling process. Additionally, reciprocation upwards of the piston into the container causes the fluid to exit from the receiving end of the container to cleanse the sides of core.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
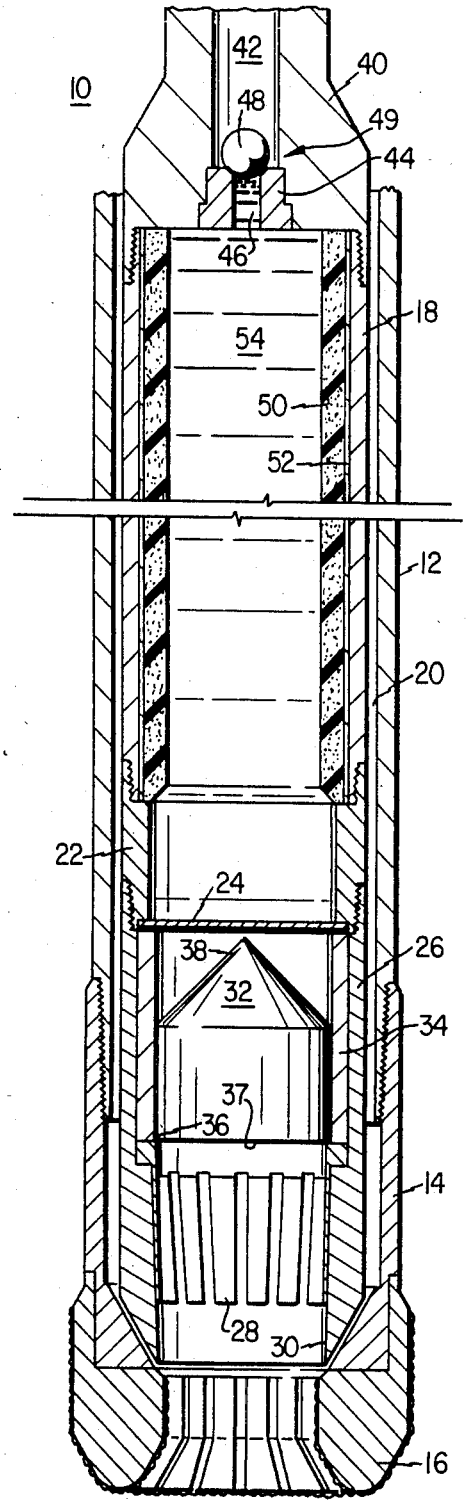
FIG. 1 illustrates a cross-sectional view of a sponge coring apparatus.
Figure 4:
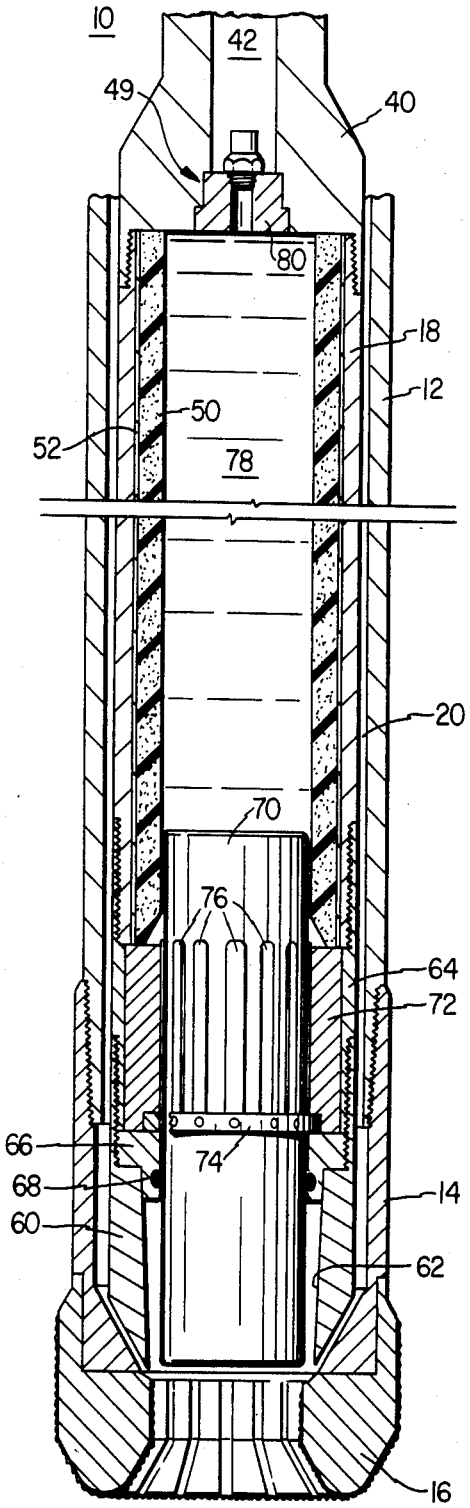
FIG. 4 illustrates a cross-sectional view of the preferred embodiment of the present invention.
Figure 5:
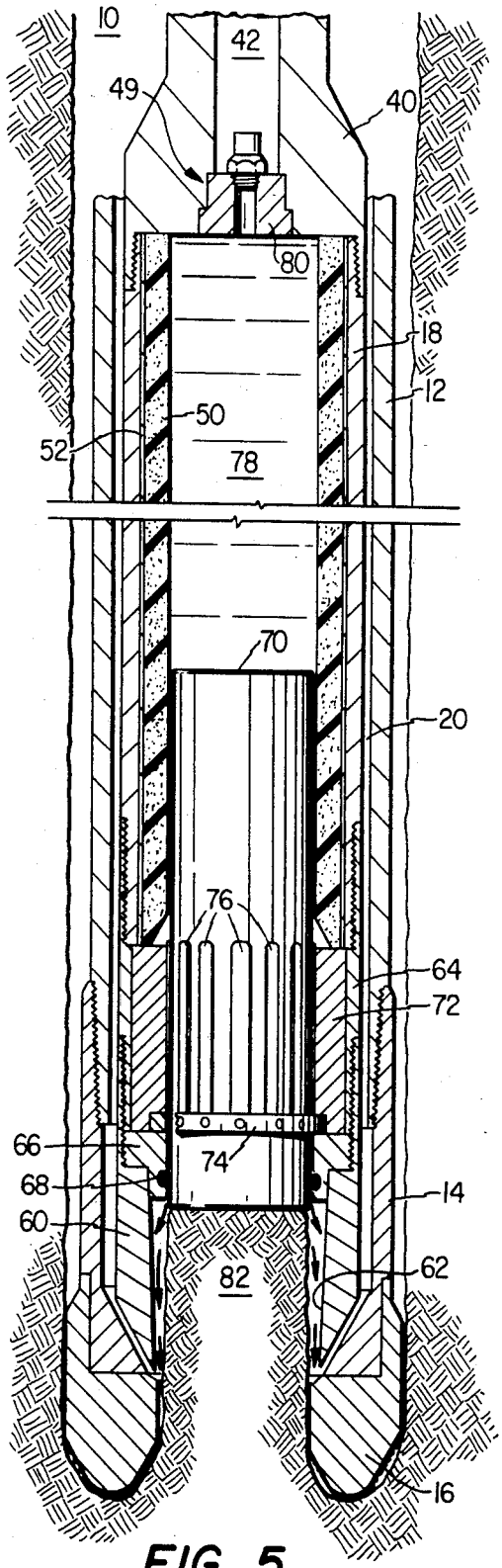
FIG. 5 illustrates a cross-sectional view of the sponge coring apparatus of FIG. 4 with the core partially disposed within the inner barrel.

Referring now to FIG. 1, there is illustrated a cross-sectional view of one embodiment of a well coring apparatus 10. The preferred embodiment is illustrated in FIGS. 4 and 5 described hereinbelow. The well coring apparatus 10 includes an outer barrel 12 that has a bit sub 14 disposed on the end thereof. The bit sub 14 is utilized to couple a coring bit 16 to the outer barrel 12. The coring bit 16, the bit sub 14 and the outer barrel 12 are co-rotatable by an external drilling apparatus (not shown) for drilling a core. The description of the coring procedure is described in U.S. Pat. No. 4,312,414, issued to the present Applicant, the body of which is incorporated herein by reference.

An inner barrel 18 is disposed within the outer barrel 12 such that an annular channel 20 is formed therebetween. This annular channel 20 allows drilling fluids to pass therethrough to the coring bit 16. The inner barrel 18 is stationary with respect to rotation of the outer barrel 12 and is designed for receiving the core that is formed during the coring process. This inner barrel 18 has a receiving end for receiving the well core and an exhaust end for exhausting material contained within the inner barrel 18 as the core progresses upward therethrough. A seal housing 22 is threadedly disposed on the receiving end of the inner barrel 18 through which the core must pass before it enters the inner barrel 18. The seal housing 22 has a rupturable diaphragm 24 disposed over the open end thereof. In order for the core to enter the seal housing 22 and the inner barrel 18, this diaphragm 24 must be ruptured.

A core catcher bowl 26 is threadedly engaged with the seal housing 22. A core catcher 28 is disposed in the core catcher bowl 26 adjacent the opening thereof. The core catcher bowl 26 has a receiving end 30 for receiving the core to be formed. The annular channel 20 is disposed between the wall formed by the outer barrel 12, the core bit sub 14 and the coring bit 16 and the wall formed by the inner barrel 18, the seal housing 22 and the core catcher bowl 26.

A piercer 32 is disposed in the core catcher bowl 26 and spaced from the sides thereof by a cylindrical insert 34. The piercer 32 is essentially a piston having a planar surface 36 for contacting the core being formed and a conical surface 38 disposed diametrically opposite the planar surface 36. The planar surface 36 is essentially perpendicular to the longitudinal axis of the overall apparatus 10. The conical surface 38 has the apex thereon oriented proximate to the longitudinal axis of the inner barrel 18 for traversal therealong. The piercer 32 is operable to pierce the rupturable diaphragm 24 in response to pressure applied to the planar surface 36 by the core being formed. The diameter of the piercer 32 is slightly larger than the upper portion of the core catcher 28 such that reciprocation downward through the coring bit 16 is prevented. Therefore, the core that is formed with the apparatus 10 is also slightly smaller in diameter than the piercer 32.

The end of the inner barrel 18 opposite that attached to the seal housing 22 has a flow tube 40 threadedly attached thereto. The flow tube 40 has an orifice 42 disposed axially therethrough. Although not shown, fluid also flows around the flow tube 40 into the annular channel 20 for passage to the surface of the coring bit 16. A check valve seat 44 is disposed in the orifice 42 of the flow tube 40. The seal 44 has an orifice 46 axially disposed therethrough to allow communication between the orifice 42 and the interior of the inner barrel 18. A check valve 48 is disposed in the seat 44 for impeding afferent flow to the inner barrel 18. However, the ball 48 is operable to allow afferent flow from the interior of the inner barrel 18 when the pressure interior thereto exceeds the pressure in the orifice 42 of the flow tube 40. The check valve ball 48 and the seat 44 form an overall check valve 49.

A cylindrical sponge 50 is disposed on the interior walls of a cylindrical support member or liner 52. The liner 52 is dimensioned to slideably fit within the inner barrel 18 adjacent the walls thereof. In the preferred embodiment, the liner 52 is fabricated from aluminum and the sponge 50 is fabricated from polyurethane foam. The use and construction of this foam is disclosed in U.S. Pat. No. 4,312,414, issued to the present Applicant.

The sponge 50 is dimensioned to define a bore through the middle thereof for receiving the core. Pressure of the drilling fluid in the orifice 42 of the check valve 49 seals the ball 48 and prevents drilling mud from entering the interior of the inner barrel 18. The rupturable diaphragm 24 prevents entrance of drilling mud from the opposite end thereof thereby resulting in a sealed chamber. As will be described hereinbelow, this chamber is filled with a fluid 54.

Figure 2:
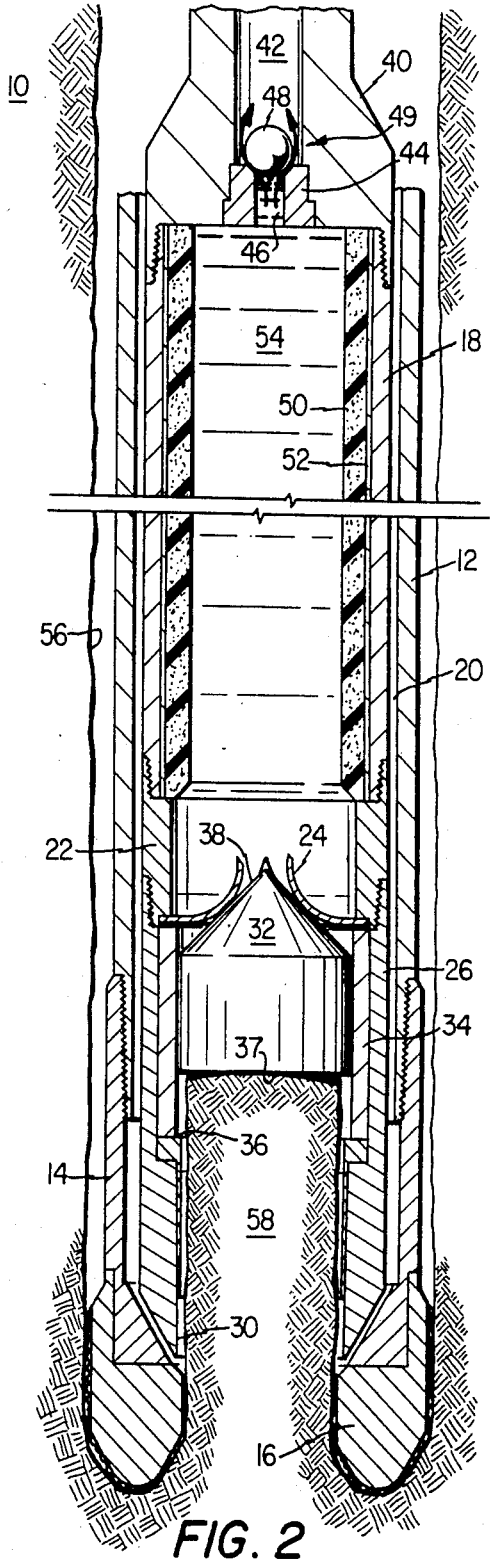
FIG. 2 illustrates a cross-sectional view of the sponge coring apparatus of FIG. 1 disposed in a subterranean well with the piercer penetrating the rupturable seal.
Figure 3:
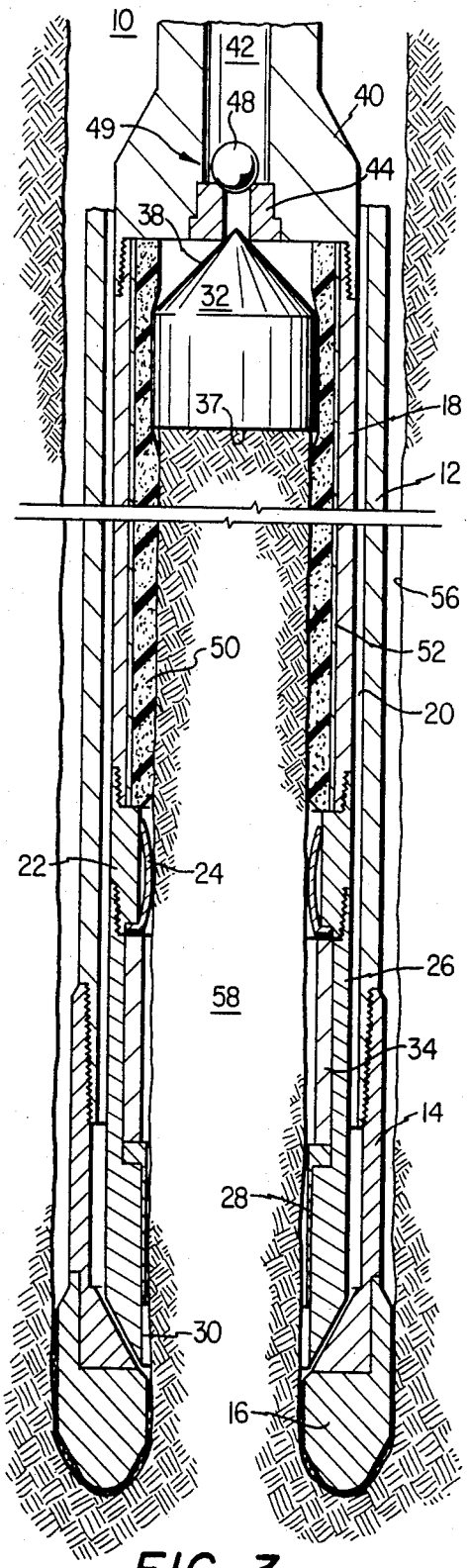
FIG. 3 illustrates a cross-sectional view of the sponge coring apparatus of FIG. 1 with the formed core fully disposed within the inner barrel.

Referring now to FIG. 2, there is illustrated a cross-sectional diagram of the apparatus 10 disposed in a subterranean well 56 and partially forming a core 58. The piercer 32 is illustrated at a position wherein the rupturable diaphragm 24 has just been ruptured. FIG. 3 illustrates the position wherein the core has passed through the rupturable diaphragm and into the interior of the inner barrel 18 for contact with the sponge 50. As illustrated, the piercer 32 advances upward into the inner barrel 18 until it contacts the upper end of the inner barrel 18. During this reciprocation, the fluid 54 contained in the interior of the inner barrel 18 passes upward through the orifice 46 with a small portion passing downward around the core 58 and out past the coring bit 16. The piercer 32, as described above, has a diameter that is slightly larger than the diameter of the core 58. In this manner, the piercer 32 forms a hole through the diaphragm 24 that is larger than the core 58 itself, thereby preventing disruption of the outer surface of the core 58. This is important in that it is the surface of the core 58 through which the oil and subterranean fluid contained therein must pass to the sponge 50.

Since the diaphragm 24 must "curl back" from the core passageway, the inner diameter of the seal housing 22 is dimensioned to be larger than that of the core 58, thereby allowing adequate room for the edges of the ruptured diaphragm 24 to be removed from the path of the core 58. When the core 58 passes into the portion of the inner barrel 18 that houses the sponge 50, the interior diameter thereof is dimensioned less than the diameter of the core 58 to form a tight fit therewith. The sponge 50 is relatively compressible in that it has a high porosity, thereby allowing a certain degree of compression.

The sealed inner barrel 18 allows location of the apparatus 10 within the bore hole without allowing drilling mud to penetrate the interior of the inner barrel 18. If the drilling mud were allowed to contact the surfaces of the absorbent member 50, there is a high probability that some of the drilling mud would "cake" on the surfaces thereof. This caking would substantially impair "bleeding" of oil or subterranan fluid from the core 58 to the absorbed member 50 for retention therein. Therefore, the use of a sealed inner barrel 18 reduces the amount of drilling mud that cakes on the surface of the core 58 prior to drilling the core itself.

During the well coring operation, the inner barrel with the sponge 50 is lowered into the subterranean well 56 at depths that result in a pressure much higher than that of atmospheric pressure. The sponge 50 is normally of the open celled type which, when subjected to increasing pressure, has a tendency to compress when the open cells are filled with a gas such as air. If the sponge 50 is inserted into the inner barrel 18 on the surface with the open cells therein filled with air, insertion into the well 58 at a higher pressure results in compression of the individual cells in the overall sponge 50. This compression results in reduced volume for absorption of mobile oil and an increased space between the surfaces of the sponge 50 and the core 58. It is preferable that the fit between the core 58 and the sponge 50 is relatively "tight" in order to, first, provide a contact between the surfaces to enhance the transfer of mobile oil from the core 58 to the sponge 50 and, second, to prevent the drilling mud that is caked around the core 58 to be disposed between the sponge 50 and the core 58.

The sponge 50 is a polyurethane foam with a very high porosity of around 70%. The permeability of this foam is approximately two darcies. To control filter cake, in one embodiment, field salt water is utilized within the inner barrel 18. Since polyurethane foam by its nature is highly oil wettable, it resists saturation by field salt water. To overcome this resistance, the inner barrel 18 with the polyurethane foam in place is evacuated with a vacuum pump prior to placing the inner barrel 18 into the outer barrel 12. After the vacuum is effected (approximately thirty inches of mercury) the polyurethane foam is then flooded with the field salt water to between 300 and 500 pounds per square inch (psi) pressure. This saturates the polyurethane foam. This wetting of the polyurethane foam is done just prior to the coring operation.

After saturation, the fluid is removed from the bore formed by the interior of the sponge 50 and the inner barrel 18. Although the fluid is drained therefrom, the open celled structure of the sponge 50 is permeated by the fluid. After draining, the inner barrel 18 is inserted into the outer barrel 12 with the diaphragm 24 in place. The fluid 54 is then disposed within the interior of the inner barrel 18 through the check valve 49 with the ball 48 removed and the ball 48 then inserted to effect the seal.

Field salt water is utilized in a situation where the oil saturation is desired since oil will displace this water from the sponge 50. The field salt water disposed in the open celled structure of the sponge 50 prevents collapse of these structures where the pressure increases after insertion of the apparatus 10 into the well 56. As oil or other subterranean fluid bleeds from the core 58, the water is displaced by the oil. In order not to contaminate the sponge 50 after the diaphragm 24 has been ruptured, the drilling mud is water based, preferably fresh water, which is readily distinguishable from the oil absorbed by the sponge 50, thereby facilitating analysis for the percentage of mobile oil contained in the sponge 50.

If water saturation of a core is to be determined with the sponge coring process, alternative fluids must be utilized. Since only a small amount of water is normally present in the core 58, it is necessary to enhance the accuracy of the retrieval and measurement process as much as possible. The mud that is used in drilling the well is preferably oil based, but it may be any base that is readily distinguishable from the water contained in the core and that does not combine with the water to form a different compound. The sponge 50 is saturated with high quality dry diesel oil. The procedure for saturating the polyurethane foam is the same as described above. This facilitates absorption of the water in the core which is readily distinguishable from the drilling fluid and the fluid contained in the sponge 50.

Under certain conditions, it is desirable to analyze the core 58 for $CO_2$. $CO_2$ at the pressures existing at the bottom of the well is normally in solution. As the apparatus 10 is retrieved from the well 56 with the core 58 enclosed therein, the pressure decreases, thereby allowing the $CO_2$ to come out of solution as a gas. Normally this gas is allowed to escape and must be retained to measure the quantity thereof. To effect a measurement of this gas, the fluid utilized in the inner container is monoethanolamine, which is a water soluble chemical with a great chemical affinity for acidic gases such as $CO_2$ and/or $H_2S$. For example, laboratory tests indicate that a 15% solution of monoethanolamine can capture at room temperature and pressure at least 25 liters of $CO_2$ per foot of polyurethane foam sponge. By utilizing monoethanolamine, any $CO_2$ that escapes from the core is captured by the sponge 50 and can be analyzed as part of the overall analysis after retrieval of the sponge 50. The sponge 50 is impregnated with the monoethanolamine as described above with reference to the field salt water.

Referring now to FIG. 4, there is illustrated the preferred embodiment of the present invention wherein like numerals refer to like parts in the various figures. In the embodiment of FIG. 4, the core catcher sub 28 in FIGS. 1–3 is replaced by a core catcher sub 60 which is similar to the core catcher sub 28 and has an opening 62 for receiving the core therein. An inner barrel sub 64 is disposed between the core catcher 60 and the inner barrel 18 and threadedly engaged therewith. The lower portion of the inner barrel sub 64 has an annular member 66 disposed around the interior of the core receiving space. The annular member 66 has an O-ring 68 disposed in a receiving groove on the surface thereof for sealing with a piston 70 which is operable to reciprocate within the coring device 10.

The piston 70 is designed to slideably fit within the sponge 50 and reciprocate upwards into the top interior space thereof. The O-ring 68 forms a liquid seal between the interior of the sponge 50 and the exterior environment of the coring device 10 when the piston 70 is disposed at the receiving end of the inner barrel 18. Therefore, communication between the exterior of the coring device 10 and the interior of the sponge 50 is prevented with the piston 70 disposed at the receiving end of the inner barrel 18.

The piston 70 has a taper provided on the end thereof proximate the O-ring 68. The diameter of piston at the middle and upper portions thereof is slightly less than the member 66 whereas the diameter of piston 70 at the lower end thereof is essentially equal to the inner diameter of the O-ring 78 in the uncompressed state. When the piston 70 is lowered from the interior of the inner barrel 18 such the tapered bottom portion of the piston 70 contacts the O-ring 68, the O-ring 68 is compressed. This compression presents a restrictive force to downward reciprocation of the piston 70, thereby preventing piston 70 from exiting the inner barrel 18.

A cylindrical member 72 is disposed about the piston 70 and adjacent the walls of the inner barrel sub 64 between the seating member 66 and the lower portion of the sponge 50. A ring member 74 is disposed between the cylindrical member 72 and the seating member 66. The ring member 74 has a plurality of upwardly reaching spring fingers 76 attached thereto which form a "core catcher" that prevents the core from falling out of the inner barrel. The piston 70 is held within the end of the coring device 10 by the O-ring 68 to prevent dislocation thereof. Until a core contacts the lower end of the piston 70, no reciprocal movement will be imparted thereto.

The sponge 50 has an interior space 78 that is filled with a fluid such as water at a predetermined pressure. The upper end of the inner barrel 18 has a quick disconnect fill plug 80 disposed therein to provide both a seal for the space 78 and also a path through which to pass the fluid. This sealed inner portion of the inner barrel 18 allows for pressurization thereof. The pressurized liquid contained within the interior 78 of the sponge 50 prevents contaminants from coming into contact with the exposed surface of the sponge 50 and being absorbed into the interstices thereof. As described above, it is important to present a clean sponge surface about the core that enters this space 78.

When pressurized fluid is disposed within the space 78, the sponge 52 compresses. This compression is a result of the semi-closed cell structure of the sponge material. By compressing the sponge 52, some of the air trapped therein in the open interstices is forced into solution whereas the air with the closed cells is compressed. Upon relieving the pressure, the sponge 52 expands and the air in solution with the fluid escapes. As will be described hereinbelow, the fluid is removed prior to a reduction in pressure followed by a simultaneous entry of the core in the inner barrel 18.

Referring now to FIG. 5, the embodiment of FIG. 4 is illustrated in a well with a core 82 partially disposed within the interior 78 of the sponge 50. As the coring device 10 is lowered into a well, the O-ring 68 maintains a seal with the piston 70 until the mud column pressure exceeds the pressure within the space 78. When this pressure is exceeded, mud can then pass about this O-ring seal. However, the fluid contained within the space 78 has a lower density than the mud. In the preferred embodiment, the fluid is water which weighs 8.34 pounds per gallon whereas the mud surrounding the piston 70 weighs approximately 10 pounds per gallon in most operations. The difference in the densities between the mud and the water causes the lower density fluid to be maintained within the interior space 70 and the higher density drilling mud to remain outside. The only way for the water contained wthin the interior 78 to exit therefrom is for the O-ring seal to be broken and the interior pressure thereof increased such that the water flows downward and out the receiving end of the inner barrel 18.

In order to break the O-ring seal, the piston 70 must be reciprocated upward therein. To facilitate this, the core 82 contacting the lower end of the piston 70 causes it to reciprocate upwards and break the O-ring seal. Once the O-ring seal is broken, fluids contained within the space 78 flow downwards around the piston 70 and around the core 82 and about the coring bit 16. This efferent flow of fluid not only allows space for the piston 72 to reciproate upwards but also performs a cleansing function on the surfaces of the core 82. This cleansing function prevents mud caking on the sides of the core which facilitates absorption by the sponge and free movement of the core up within the interior of the coring device. The result is a clean surface on the sponge 50 and also a clean surface on the core 82. When the coring device is removed from the well with the detached core 82, fluids draining outward therefrom as a result of the lower pressures at the surface of the well are allowed to freely travel from the core to the sponge and be absorbed thereby. This facilitates analysis of the device.

In summary, there has been provided an apparatus for sponge coring that utilizes a sealed inner barrel disposed within an outer well coring barrel. The inner barrel is sealed at the upper end and has a reciprocating piston disposed in the other end thereof with an O-ring seal disposed thereabout. A sponge is disposed around the inner walls of the inner barrel for receiving the core and absorbing fluids therefrom. The inner barrel is filled with a fluid that is pressurized. The piston is reciprocated upward by the core that enters the inner barrel and this upward movement causes the fluid contained within the inner barrel to pass outward about the piston and the core to wash mud away from the face of the core to a clean surface for the sponge. In addition, the fluid contained within the core prevents drilling mud from circulating about the sponge and contaminating the interstices thereof.

Although the preferred embodiment has been described in detail, it should be understood that various changes, substitutions and alterations can be made therein without departing from the spirit and scope of the invention as defined by the appended claims.

What is claimed is:

1. A well core drilling apparatus for recovery of subterranean fluid, comprising:

means for boring a well core containing subterranean fluid;

container means associated with said boring, means for receiving said well core at one end and containing said well core;

said container means sealed at the opposite end from said receiving end;

an absorbent member disposed on the inner walls of said container means and positioned adjacent said well core, said absorbent member for absorbing subterranean fluid that bleeds from said well core;

a reciprocating piston disposed in the receiving end of said container means for being reciprocated from the receiving end of said container means to the opposite end of said container means by said core when said core enters said container means;

means for sealing the space between said piston and the inner walls of said container means when said piston is disposed at the receiving end thereof, reciprocation of said piston from the receiving end of said container means and upward therein breaking the seal; and a fluid disposed in said container for preventing contaminants external to said container means from entering said container means and contaminating said absorbent member;

said fluid being pressurized to exert a force on said piston outward from said container means to maintain the seal provided by said sealing means;

reciprocation of said piston upwards within said container means causing fluid to exit from said container means to wash contaminants from said well core.

2. The apparatus of claim 1 wherein said fluid in said container means has a density higher than the density of fluids external to said container means.

3. The apparatus of claim 1 wherein said sealing means comprises an O-ring disposed in an annular groove on the inner surface of the receiving end of said container means for cooperating with the outer surface of said piston.

4. The apparatus of claim 3 wherein the receiving end of said piston is tapered inwardly and downwardly to cooperate with said O-ring to provide a restricting force to downward reciprocation such that said piston is prevented from exiting said container means.

5. The apparatus of claim 1 wherein said container means comprises a hollow fluid impermeable right circular cylinder and said absorbent member comprises an absorbent right circular cylinder with a bore defined therethrough and dimensioned to fit within said impermeable cylinder adjacent the walls thereof and axially aligned therewith.

6. The apparatus of claim 1 wherein said fluid comprises water that is pressurized within said container means.

7. The apparatus of claim 1 and further comprising means for filling said container means with said fluid at a predetermined pressure.

8. A well core drilling apparatus for recovery of subterranean fluid in a well core, comprising:

an outer barrel for rotation in a bore hole;

a drill bit mounted on the end of said outer barrel for drilling a core;

means for rotating said outer barrel;

an inner barrel disposed within said outer barrel and stationary with respect to the rotation of said outer barrel;

absorbent means diposed in said inner barrel for enclosing and containing the well core and absorbing subterranean fluids contained therein to provide a profile thereof along the longitudinal axis of the well core;

said inner barrel sealed at one end opposite the end for receiving said core;

a reciprocating piston disposed in the receiving end of said inner barrel for reciprocation along the longitudinal axis thereof by said core, the receiving end of said piston tapered inwardly and downwardly;

an O-ring formed in the receiving end on the walls of said inner barrel for cooperating with the tapered end of said piston to form a seal therewith, the taper of said piston in cooperation with said O-ring restricting downward reciprocation of said piston such that exit of said piston from said inner barrel is prevented;

a pressurized fluid disposed in said inner barrel and having a density greater than the density of fluids external to said inner barrel;

means for disposing said fluid in said inner barrel;

said piston reciprocated upward when a core contacts the lower end thereof to break the seal formed by said O-ring and said piston to allow said fluid to exit from said inner barrel and wash contaminants from the core when the core enters said inner barrel such that a clean surface is exposed to said absorbent means; and said fluid preventing large amounts of contaminants from entering said inner barrel and contaminating said absorbent means as a result of the lower density thereof.

9. The apparatus of claim 8 wherein said absorbent means comprises a hollow cylinder of absorbent material and disposed in said inner barrel proximate to the sides of the well core for absorbing the subterranean fluids therefrom.

10. The apparatus of claim 9 wherein said absorbent material is compressible, the interior diameter of said hollow cylinder of absorbent material less than the diameter of the well core such that said compressible material is compressed to form a tight fit around the well core.

11. The apparatus of claim 10 wherein said compressible material is polyurethane foam.

12. The apparatus of claim 8 wherein said fluid comprises water.

13. The apparatus of claim 8 wherein said means for disposing comprises a quick disconnect valve.

14. A method for drilling a well core and recovering subterranean fluids disposed therein, comprising:

drilling the well core;

providing an inner barrel for containing the well core, the inner barrel having a receiving end for receiving the well core as it is formed;

disposing absorbent material in the inner barrel for absorbing the subterranean fluid that is contained in the well core for later retrieval and analysis;

sealing the end of the inner barrel opposite the receiving end thereof;

disposing a reciprocating piston in the receiving end of the inner barrel, the piston contacting the well core and reciprocating within the inner barrel from the receiving end to the opposite end thereof as the well core moves upward into the inner barrel;

sealing the space between the reciprocating piston and the inner walls of the inner barrel at the receiving end thereof such that the receiving end of the inner barrel is sealed to provide a completely sealed inner barrel;

disposing a pressurized fluid within the inner barrel to maintain the seal at the receiving end of the inner barrel; and breaking the seal at the receiving end of the inner barrel when the well core contacts the piston and reciprocates it within the inner barrel from the receiving end thereof to cause the fluid to flow outward through the receiving end of the inner barrel to wash the core entering the inner barrel.

* * * * *

UNITED STATES PATENT AND TRADEMARK OFFICE

CERTIFICATE OF CORRECTION

PATENT NO. : 4,598,777

DATED : July 8, 1986

INVENTOR(S) : Arthur Park, Bob T. Wilson

It is certified that error appears in the above-identified patent and that said Letters Patent is hereby corrected as shown below:

Col. 2, line 3, "fluid. a container" should be
--fluid. A container--.

Col. 6, line 38, between "such" and "the" insert --that--.

Col. 8, line 13, "said boring, means" should be
--said boring means--.

Signed and Sealed this

Twenty-eighth Day of October, 1986

[SEAL]

*Attest:*

DONALD J. QUIGG

*Attesting Officer*

*Commissioner of Patents and Trademarks*